US005340944A

United States Patent [19]

Wang

[11] Patent Number: 5,340,944

[45] Date of Patent: Aug. 23, 1994

[54] CONSTRUCTION OF AN ELECTROMAGNETIC INTERFERENCE FILTER

[75] Inventor: Frank Wang, Taoyuan, Taiwan

[73] Assignee: Delta Electronics, Inc., Taoyuan, Taiwan

[21] Appl. No.: 47,462

[22] Filed: Apr. 19, 1993

[51] Int. Cl.[5] ..... H01R 13/66

[52] U.S. Cl. ..... 174/52.1; 248/27.3; 333/185; 336/90; 361/818; 439/620

[58] Field of Search ..... 333/181-185, 333/222; 200/296; 361/104, 111, 622, 623, 641, 679, 728, 800, 803, 801, 816, 818; 439/607, 620; 336/90; 174/52.1; 248/27.1, 27.3

[56] References Cited

U.S. PATENT DOCUMENTS 4,713,633 12/1987 Saito ..... 333/222
4,816,966 3/1989 Frankowski ..... 361/356
5,221,215 6/1993 Tan ..... 439/620
5,256,841 10/1993 Zanella ..... 200/296
5,257,950 11/1993 Leuker ..... 439/620

*Primary Examiner*—Gerald P. Tolin

[57] ABSTRACT

An electromagnetic interference filter has an input socket, an insulated base, an insulated upper cover, a metal case, an L-shaped, elongated ground terminal, two short output terminals, a grounded bridge hook, two spring plates and the internal circuit elements. The two spring plates are fitted into openings on the upper and lower surfaces of the metal case which covers the insulated base. An oblique protruding block on either side of the input socket penetrates through a square hole on either side of the metal case to couple the case to the input socket. Upwardly oblique extending spring plates are provided on both of the upper and lower surfaces of the metal case which spring plates are pressed against casing walls to hold the assembly firmly and stably immobilized onto the casing walls.

4 Claims, 6 Drawing Sheets

CONSTRUCTION OF AN ELECTROMAGNETIC INTERFERENCE FILTER

BACKGROUND OF THE INVENTION

1. Field of the Invention

The present invention relates to an improvement in the construction of an electromagnetic interference filter, especially to one that has two spring plates fixed onto the upper and lower end of the metal case thereby the assembly is pressed against the casing wall to achieve the effect of easily assembling of the entire filter and stably immobilize onto the casing wall.

2. Description of the Prior Art

As shown in FIG. 1, a conventional electromagnetic interference filter has an immobilization lug consisting of a plate with through hole on either side thereof and is locked fixed onto the casing by a screw penetrating through the fixing lug. Said electromagnetic interference filter has the following drawbacks while in use:

1. Limited by the accuracy of the size and the location of the screw hole, the results are a high manufacturing cost of casing panels and an increased rejection rate.
2. Manual assembly is reqired for fixing with a screw and results in no way of automatic and mass production as well as time consuming and labor cost increasing.
3. For a traditional screw fixing method, the area of the panel should be enlarged to accomodate the screw hole and the panel can not have a versatile design.

In view of the above mentioned drawbacks of the conventional electromagnetic interference filter, the inventor devoted to improving said shortcomings and finally completed the invention.

SUMMARY OF THE INVENTION

Thus, the present invention is directed to provide an improvement in the construction of an electromagnetic interefence filter which is aimed at improving the way of installation and fixing as well as the internal assembly of a filter with a spring plate (spring chuck) fixing instead of the usual screw fixing, thereby not only an enhanced efficiency and a simple installation are achieved, but also a significant cost reduction and a labor saving are achieved.

Another object of the invention is to provide an improvement in the construction of an electromagnetic interference filter which utilizes the fixing method of inserting a spring plate to press against the panel of the casing therefore, it can be put into a mass and fast assembly production adaptable for the facilities for automation and further saves the labor as well as reduces the cost.

An yet another object of the invention is to provide an improvement in the construction of an electromagnetic interference filter which has no need to keep any provision hole on panel for fixing the screw such that effectively reduces the area of the panel and gives a more versatile design of the panel.

A more complete understanding of these and other features and advantages of the present invention will become apparent from a careful consideration of the following detailed description of certain embodiments illustrated in the accompanying drawings.

DETAILED DESCRIPTION OF THE PREFERRED EMBODIMENTS

Figure 1:
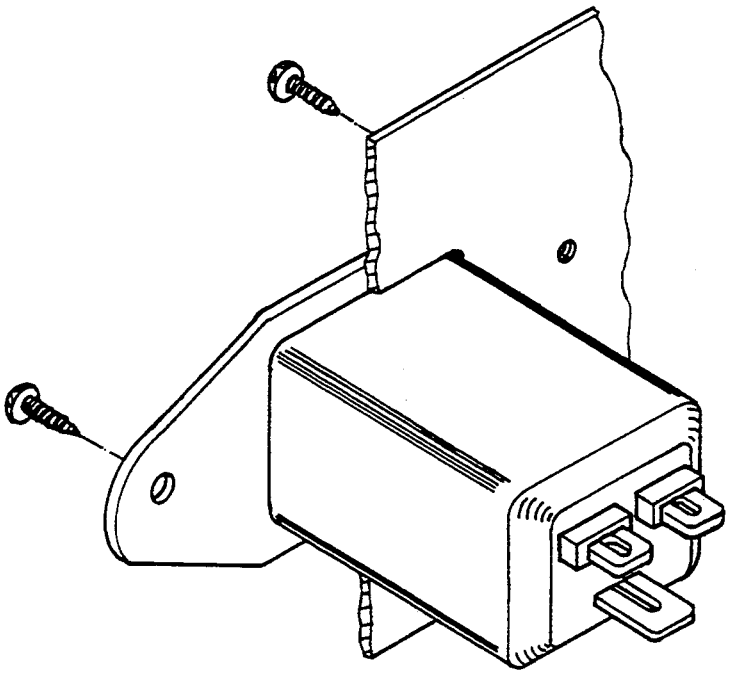
FIG 1 (PRIOR ART)
FIG. 1 is a perspective view of a conventional electromagnetic interference filter.

The construction of the conventional electromagnetic interference filter shown in FIG. 1 and the drawbacks thereof were described as hereinbefore so it will not be repeated here.

Figure 2:
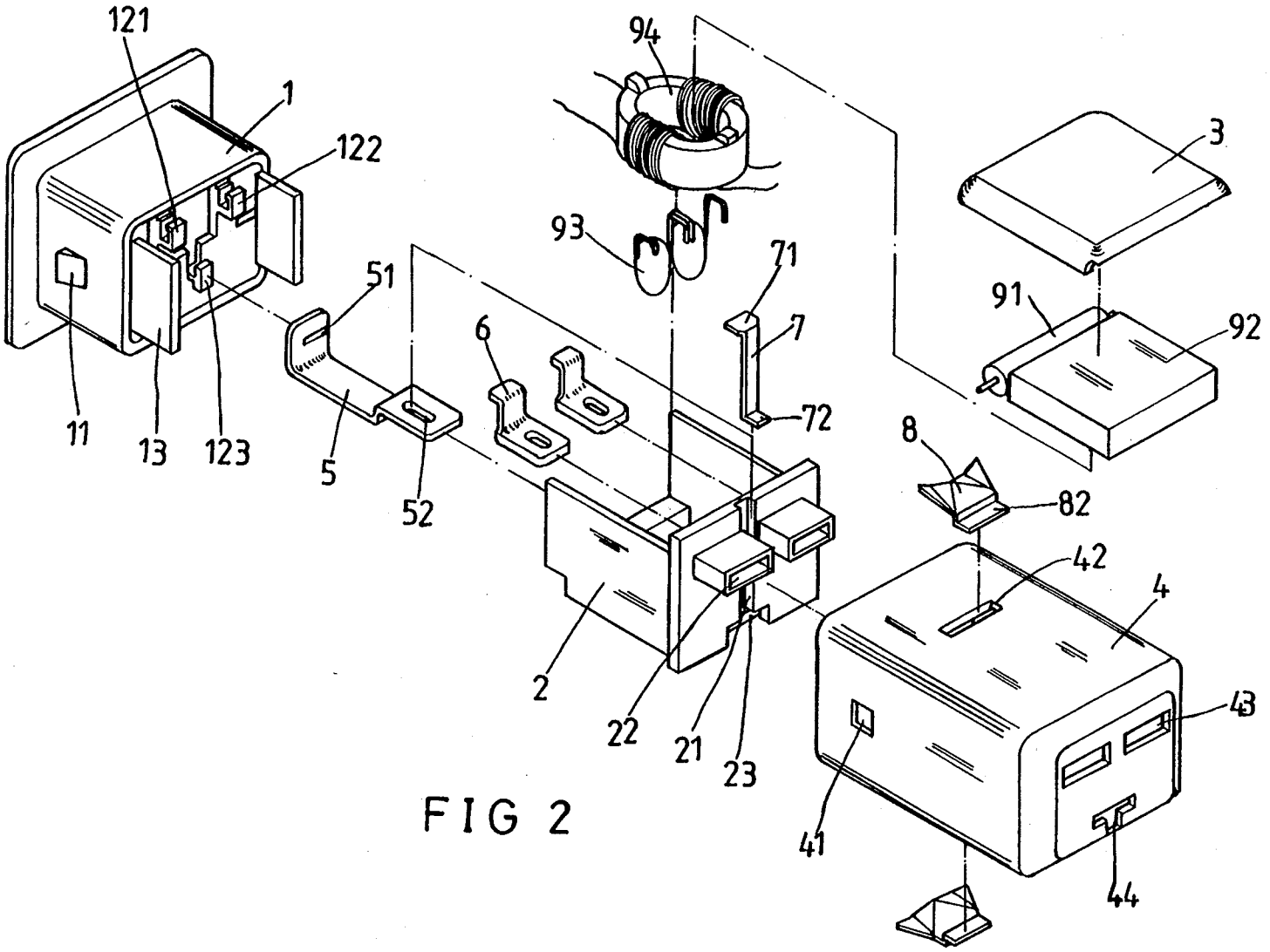
FIG. 2 is an exploded view showing the construction of an electromagnetic interference filter of the present invention.

FIG. 2 is an exploded view showing the construction of an electromagnetic interference filter according to the present invention. It can be clearly seen from said figure that the electromagnetic interference filter according to the invention essentially comprises an input socket 1, an insulated base 2, an insulated upper cover 3, a metal case 4, an L shape elongated grounded terminal 5, a short output terminal 6, a grounded bridge hook 7, two spring plates 8 and the circuit elements and parts, in which there is provided at either side of the input socket 1 an oblique protruded block 11, as well as at the rear side thereof L, N and G end dowel pins 121, 122, 123. A damper 13 is provided at either side of the rear portion and the aforesaid G end dowel pin 123 is in the form of a T protrusion.

The front portion and the upper portion of the insulated base 2 form two open surfaces. A vertical groove 21 is provided at the center of the rear portion. Two outer protruded open ports 22 are provided at both sides of the vertical groove 21 and an expanded recess 23 at the bottom side of the vertical groove 21.

The insulated upper cover 3 may cover the insulated base 2.

At either side of the front portion of the metal case 4, a square hole 41 is provided. Metal case 4 has an elongated channel 42 on each of the upper and lower surfaces, the front side thereof is open, and two rectangular holes 43 at the upper part of the back face as well as a T shape opening 44 at the lower part.

The L shape elongated grounded termainal 5 has a transverse open recess 51 at the front upwardly vertical portion and a long hole 52 at the back end.

The short output terminal 6 is in the form of an L.

The grounded bridge hook 7 is a thin plate which has its upper and lower tips protruded perpendicularly to form a front and a back protruded plates 71, 72.

The spring plate 8 is in the form of a wing shape and has two oblique upwardly protrusions 81 provided at both sides and a L-like recession 82 at the rear end.

Circuit elements include a resistor 91, an inductor 94 and a plurality of capacitors 92, 93 thereby to compose a conventional filter circuit.

Figure 3A:
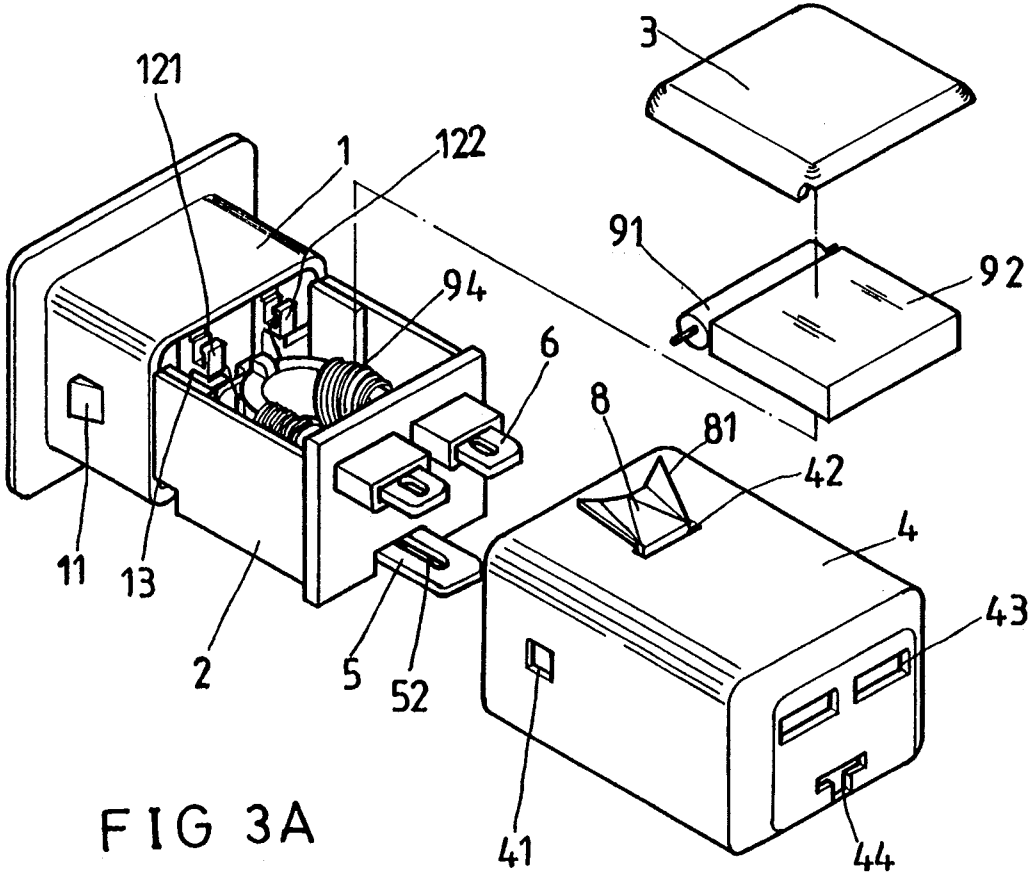
FIG. 3A is a an exploded perspective view showing the assembly of the electromagnetic interferenece filter of the invention.
Figure 3B:
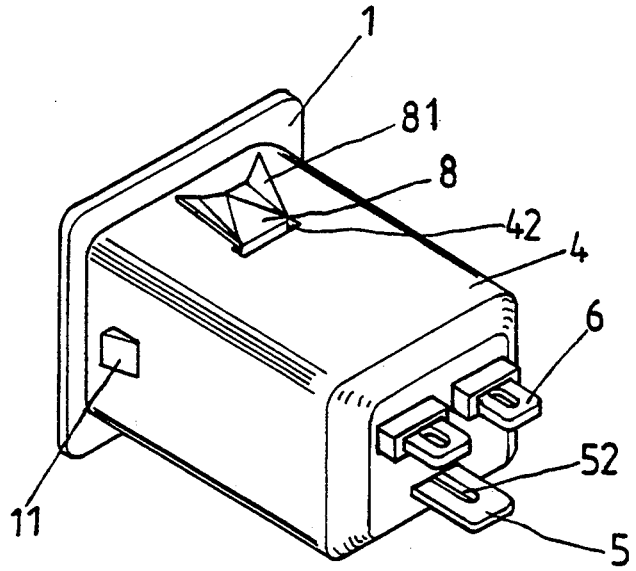
FIG. 3B is a perspective view of the electromagnetic interference filter of the invention in whole.

FIG. 3 embodies the electromagnetic interfernce filter of the invention in whole physical view. It can be seen from said figure that its assembly procedure comprises allowing the transverse open recess 51 of the L shape elongated grounded termainal 5 mounted with the T-like protrusion of the G end dowel pin 123 of the input socket 1; then allowing the open front end of the insulated base 2 joined to the rear side of the input socket 1 to let the rear end of the L shape elongated grounded terminal 5 extended outside of the expanded recess 23 of the insulated base 2; the grounded bridge hook 7 extending into the vertical groove 21 with the front protruded plate 71 attatched on top of the vertical groove 21 and the rear protruded plate 72 penetrated into the long hole 52 whereby the input socket 1 and the insulated base 2 can be firmly combined by means of the clamping of the grounded bridge hook 7 and two dampers 13 of the input socket 1 pressing against the two internal sides of the insulated base 2; the short output terminal 6 penetrating out of the outer protruded open port 22 on back of the insulated base 2; having the circuit elements connected between the L, N end dowel pins 121, 122 and the short output terminal 6 (said circuit part is a conventional circuit and not a part of the invention so it will not be elaborated here); thereafter covered with the insulated upper cover 3, the L-like recession 82 of ther spring plates 8 being extended into the elongated groove 42 of the metal case 4 and then joint connecting the metal housing 4 around the insulated base 2; by means of the close attatching and fitting between the metal case 4 and the insulated base 2 or the insulated upper cover 3 to grasp the spring plate 8, at which time the oblique protruded block 11 of the input socket 1 penetrates into and chucks with the square hole 41, furthermore, the short output terminal 6 extendes out of the rectangular hole 43, and the engagement portion of the end of the L shape elongated grounded terminal 5 and the back protruded plate 72 of the grounded bridge hook 7 extendes out of the T-like opening 44; thereafter, the engagement portion of the end of the L shape elongated grounded terminal 5 and the back protruded plate 72 together tin are welded on the rear face of the metal housing 4 for the purpose of achieving double functions of grounding and immobilizing.

Figure 4:
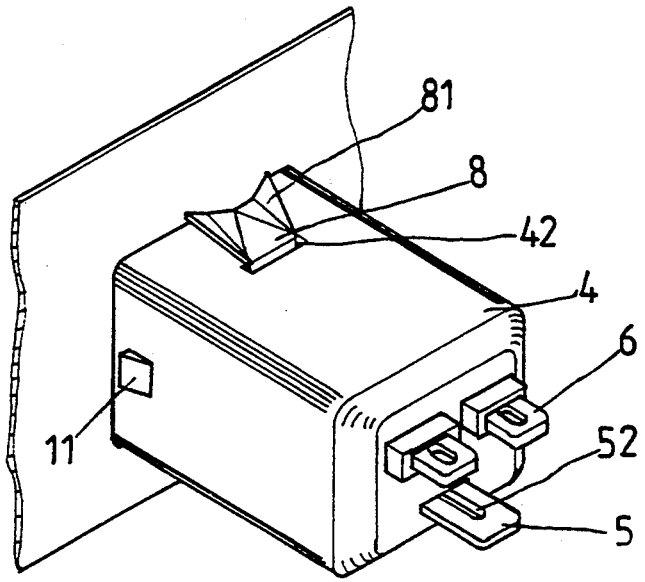
FIG. 4 is a perspective view of the electromagnetic interference filter of the invention.

FIG. 4 is an embodiment showing the practice of the invention. As shown in said figure, in an embodiment of the invention, by means of the spring plate 8 of the metal case 4 pressing against the panel of the casing, the whole assembly is held and fixed on the panel of the casing. It can be mentioned that the spring plate 8 itself is in the form of an arch such that while pressed against the panel of the casing, a tension is produced to form a point attachment between them thereby the stability is further increased.

Figure 5:
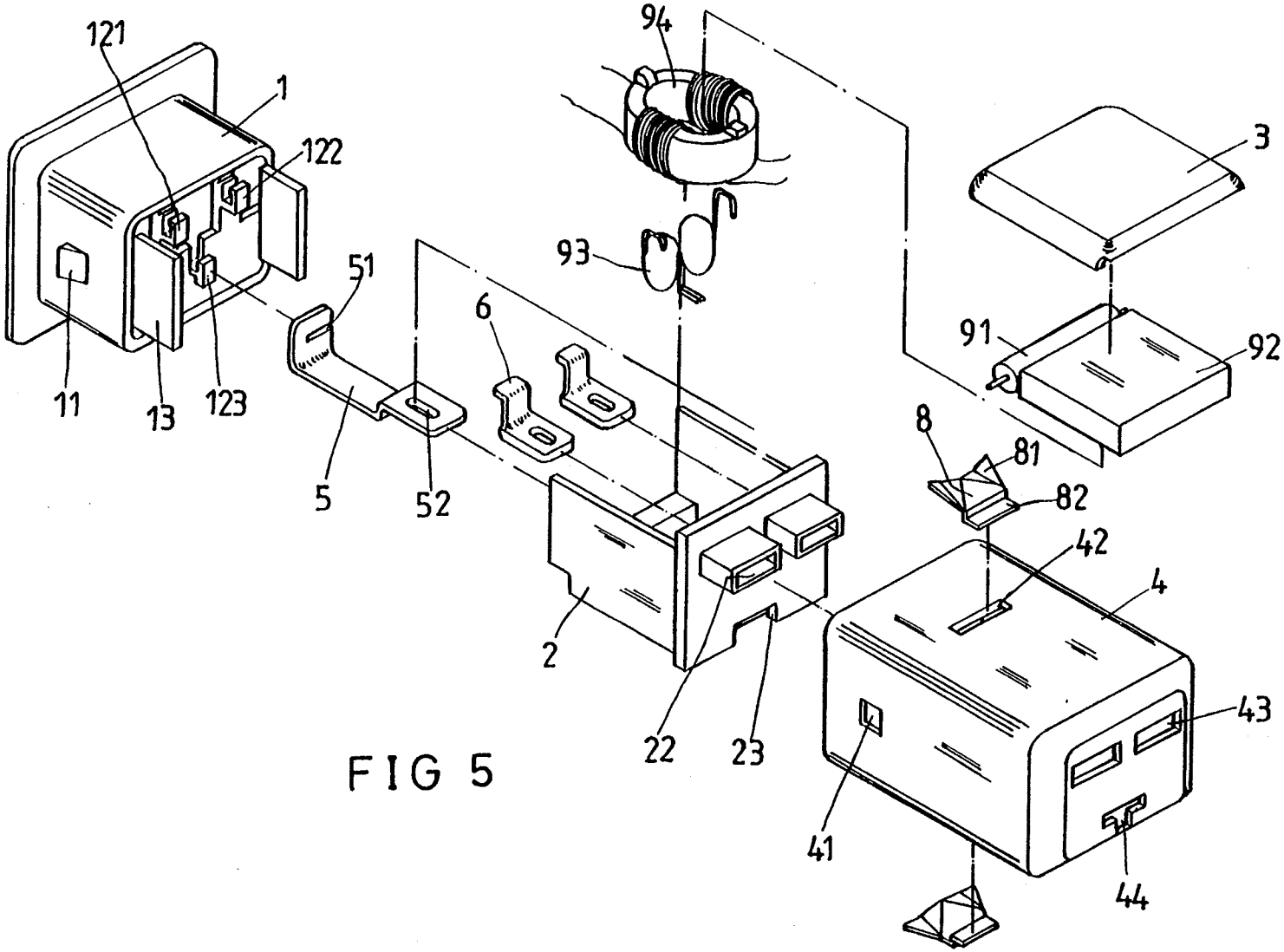
FIG. 5 is an exploded perspective view showing another assembly embodiment of the filter of the invention.

FIG. 5 is a schematic view showing another assembling embodiment of the invention. In said embodiment, the original grounded bridge hook 7 is omitted and replaced with a co-grounded wiring connected to a pair of capacitors 93 soldered on the rear end long hole 52 of the L shape elongated grounded terminal 5.

Figure 6:
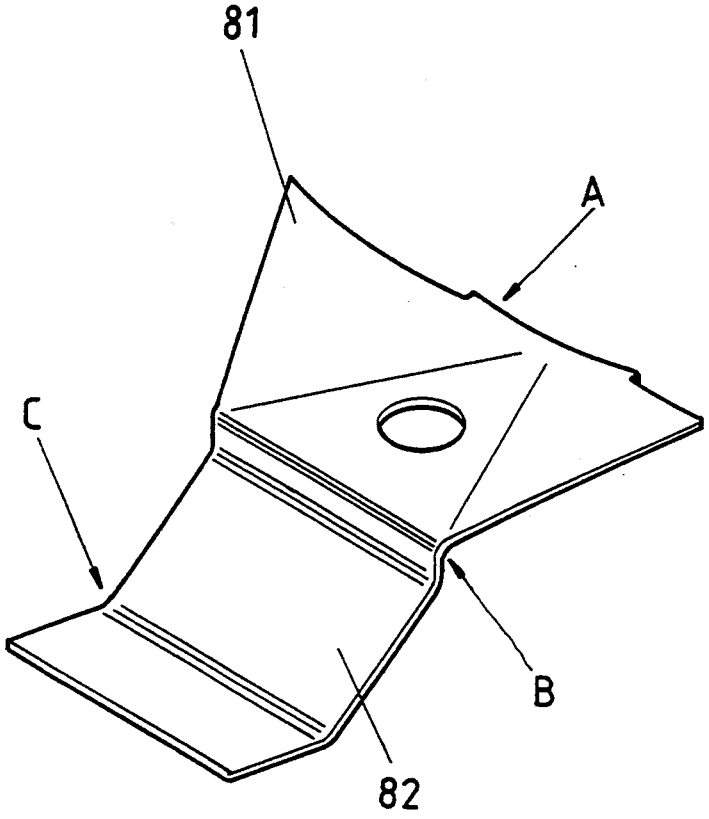
FIG. 6 is an enlarged perspective view of the spring plate according to the invention.

FIG. 6 is an enlarged schematic view of the spring plate according to the invention. As shown in said figure, two oblique upwardly protrusions 81 of the spring plate 8 is in the form of arch A, therefore, while less aseembly force is applicable and better chuck effect is obtained. An angle exists between the oblique protrusion 81 and the rear L-like recession 82 whereby after assembly, the rear oblique protrusion 81 plainly presses the metal case 4 and the terminal tip of the L-like recession 82 projects upwardly by an angle C which while compressed by a force will make the spring plate 8 more firmly and more closely located between the metal case 4 and the insulated base 2 or the insulated upper cover 3.

Although the present invention has been described with a certain degree of particularity, the present disclosure has been made by way of example and changes in details of structure may be made without departing from the spirite thereof.

I claim:

1. An electromagnetic interference filter comprising a) an input socket having a plurality of dowel pins and at least one oblique protruding block;

b) an insulated base having an insulated upper cover, and a plurality of terminals in contact with the dowel pins and extending from the insulated base;

c) a metal case defining a plurality of first holes through which the plurality of terminals extend, at least one second hole located so as to be engaged by the at least one oblique protruding block so as to attach the metal case to the input socket such that the metal case encloses the insulated base, and an elongated opening on opposite surfaces of the metal case; and, d) a spring plate located in each of the elongated openings, each spring plate having obliquely extending protrusions extending generally away from an adjacent surface of the metal case.

2. The electromagnetic interference filter of claim 1 wherein the spring plate further comprises a generally "L" shaped portion which engages the elongated opening to attach the spring plate to the metal case.

3. The electromagnetic interference filter of claim 2 wherein the input socket has opposite sides and comprising an oblique protruding block on each opposite side.

4. The electromagnetic interference filter of claim 1 wherein the input socket has opposite sides and comprising an oblique protruding block on each opposite side.

* * * * *